US005392905A

United States Patent [19]

Focke et al.

[11] Patent Number: 5,392,905

[45] Date of Patent: * Feb. 28, 1995

[54] HINGE-LID PACK, ESPECIALLY FOR CIGARETTES

[75] Inventors: Heinz Focke; Helmut Granz, both of Verden, Germany

[73] Assignee: Focke & Co. (GmbH & Co.), Verden, Germany

[ * ] Notice: The portion of the term of this patent subsequent to May 3, 2011 has been disclaimed.

[21] Appl. No.: 212,851

[22] Filed: Mar. 15, 1994

Related U.S. Application Data

[62] Division of Ser. No. 854,698, Mar. 20, 1992, Pat. No. 5,307,925.

[30] Foreign Application Priority Data

Mar. 23, 1991 [DE] Germany ..... 4109702

[51] Int. Cl.[6] ..... B65D 85/10

[52] U.S. Cl. ..... 206/266; 206/268; 206/271; 206/273

[58] Field of Search ..... 206/266, 268, 273, 271, 206/270

[56] References Cited

U.S. PATENT DOCUMENTS

| | | | |
|---|---|---|---|
| 2,247,870 | 7/1941 | Chalmers . | |
| 3,874,581 | 4/1975 | Fox et al. | 206/268 |
| 4,753,383 | 6/1988 | Focke et al. | 206/271 X |
| 4,923,059 | 5/1990 | Evers et al. | 206/265 |
| 5,044,550 | 9/1991 | Lamm | 206/266 |
| 5,079,948 | 3/1992 | Campbell | 206/270 |
| 5,129,513 | 7/1992 | David et al. | 206/271 |
| 5,307,925 | 5/1994 | Focke et al. | 206/266 |

FOREIGN PATENT DOCUMENTS

| | | | |
|---|---|---|---|
| 205766 | 12/1986 | European Pat. Off. . | |
| 434962 | 7/1991 | European Pat. Off. . | |
| 1054373 | 4/1959 | Germany . | |
| 1062172 | 7/1959 | Germany . | |
| 380013 | 8/1964 | Switzerland . | |
| 1178702 | 1/1970 | United Kingdom | 229/160.1 |
| 2059387 | 4/1981 | United Kingdom . | |

*Primary Examiner*—David T. Fidei

*Attorney, Agent, or Firm*—Sughrue, Mion, Zinn Macpeak & Seas

[57] ABSTRACT

In hinge-lid packs comprising a pack part (12) and a lid (13) hinged to a pack rear panel (15) it is difficult to ensure a precise closed position of the lid (13). This is particularly the case in hinge-lid packs with rounded longitudinal edges (10, 11). To create an additional closing force, outwardly directed deformations, particularly convexities (38), are formed in the free portion of collar side panels (28, 29) of a collar (26). These convexities abut the inner sides of the lid side panels (17) with an increased friction and thus create an increased closing force. The deformation of the collar side panels (28, 29) is a result of longitudinal collar edges (30, 31) diverging towards the free edge. As a result, there is a strain of material which effects the deformation of the collar side panels (28, 29). A further or alternative closing aid is provided in the form of an upright or inclined cut (39) arranged in the region of the collar side panels (28, 29). As a result of the convexity (38), this cut (39) forms a projecting retaining edge which also abuts the inner side of the pack side panels (28, 29) and creates an increased closing force. Moreover, the pack or the blank has a special design, such that rounded contours at the ends of the blanks fit into one another and can be severed from a piece of material without any waste.

8 Claims, 3 Drawing Sheets

HINGE-LID PACK, ESPECIALLY FOR CIGARETTES

This application is a divisional of Application Ser. No. 07/854,698, filed Mar. 20, 1992, now U.S. Pat. No. 5,307,925.

BACKGROUND OF THE INVENTION

The invention relates to a hinge-lid pack made of (thin) cardboard, especially for accommodating a cigarette group, comprising a pack part and a lid which is pivotably attached thereto, and including a collar with a collar front panel and collar side panels, which collar is arranged in the pack part and partially projects therefrom, the portion of the collar which projects from the pack part being surrounded by the lid when the latter is in a closed position.

Hinge-lid packs are used world-wide as a packaging means for cigarettes.

A certain deficiency in this type of pack is that, in the closed position, the lid does quite often not retain the desired precise closing position in which free closing edges of the lid abut corresponding closing edges of the pack part. Instead, an open gap forms between lid and pack part on the front side of the pack. This effect particularly occurs in hinge-lid packs with rounded or polygonal longitudinal edges.

Closing aids have already been suggested (DE-A 30 37 109) in order to provide a remedy for this deficiency. This prior art teaches inwardly directed deformations which are arranged in the collar side panels. When the hinge-lid pack is closed, the se deformations interact with corresponding deformations on the inside of the lid side panels.

This known closing aid for hinge-lid packs is relatively complicated and expensive to manufacture. Besides, it effects undesirable changes of the design of the hinge-lid pack.

SUMMARY OF THE INVENTION

The invention is based on the object to propose a hinge-lid pack with an improved closing aid for the lid. In particular, the closing aid must be easy to manufacture and must not effect any noticable changes of the pack itself.

To attain this object, the hinge-lid pack according to the invention is characterized in that at least one of the collar side panels has an outwardly directed deformation in the upper portion which projects from the pack part, and in that in the closed position, lid side panels abut the deformation with their inner side with an increased frictional contact.

With the closing aid according to the invention, the portion of the collar which projects from the pack part is outwardly deformed at the collar side panels in such a way that the conventionally designed inner faces of lid side panels abut the collar side panels in the closed position with an increased friction. This does not impede the closing and opening process.

According to the invention, the collar side panels are automatically deformed in terms of an outwardly directed convexity by means of an appropriate design of the collar, such that the deformation is formed when the collar is inserted into its proper position in the pack part.

According to a preferred embodiment of the invention, longitudinal collar edges are arranged between the collar front panel and the collar side panels in a diverging manner, such that the width of the collar front panel increases towards the top, that is to say towards the free edge which projects from the pack part. The inclination of the longitudinal collar edges relative to the normal position is preferably 2° relative to the vertical line.

As a result of this design, the collar sits inside the pack part of the hinge-lid pack with a narrower portion (of the collar front panel). The free portion of the collar which projects from the pack part increasingly widens. When the collar is arranged in the pack part in its proper position, this geometric form of the longitudinal collar edges automatically creates an outwardly directed convexity in the upper portion of the collar side panels which projects from the pack part. The dimensions are defined such that the convexity of the collar side panels projects beyond the contour which is otherwise defined by the collar, so that, when the lid is being closed and in the closed position of the lid, lid side panels rest with their inner faces against the collar side panels with an increased friction and thus effect an additional closing force.

The hinge-lid pack and, accordingly, the collar are preferably formed with rounded longitudinal (collar) edges. Each of these edges is defined by a group of parallel grooves.

According to a proposal of the invention, punch cuts which are upright or follow the longitudinal collar edges act as a further closing aid and are arranged in the collar side panels. As a result of the deformation or convexity, these punch cuts form projecting edges which also increase the closing force.

Another outstanding feature of the hinge-lid pack according to the invention is the design of the lid front panel. According to the invention, the lid front panel is a single-layer panel and has the shape of a rounded tongue. In the region of a pack front panel, a blank is provided with an appropriately rounded edge (pack butt edge) which corresponds to the contour of the edge (lid butt edge) of the lid front panel. This allows a material-saving arrangement of blanks within a sheet.

Further details of the invention will be described below with reference to an exemplary embodiment and corresponding drawings, in which.

DESCRIPTION OF A PREFERRED EMBODIMENT

Figure 1:
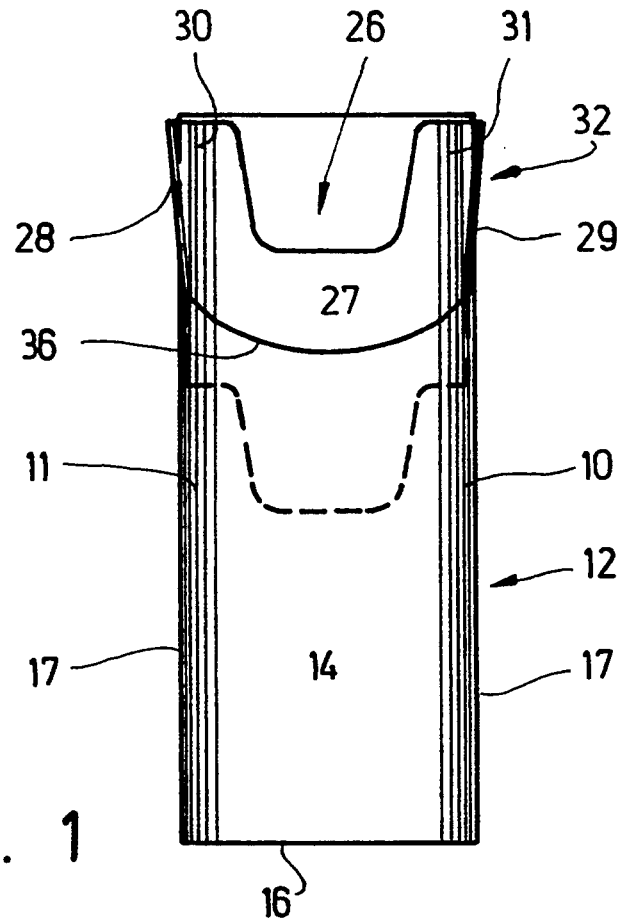
FIG. 1 is a front view of a hinge-lid pack in the open position.
Figure 2:
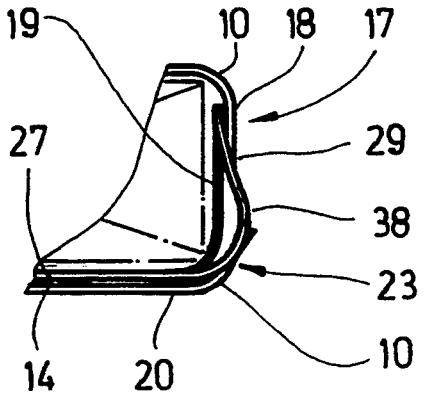
FIG. 2 is a plan view of a detail of the hinge-lid pack of FIG. 1, particularly a fraction of an upper edge portion, on an enlarged scale.

The preferred embodiment shown in the drawings is a hinge-lid pack whose four upright longitudinal edges 10, 11 are rounded. The hinge-lid pack comprises a pack part 12 and a lid 13 pivotably attached thereto. FIG. 1 shows a front view of the hinge-lid pack with an open lid 13 which is out of sight because it is pivoted fully to the rear.

The pack part 12 typically comprises a pack front panel 14, a pack rear panel 15 and a bottom 16. Pack side panels 17 are formed from partially overlapping side tabs 18 and 19.

Accordingly, the lid 13 comprises a lid front panel 20, a lid rear panel 21 and an end panel 22. Lid side panels 23 are formed from overlapping lid side tabs 24.

Figure 3:
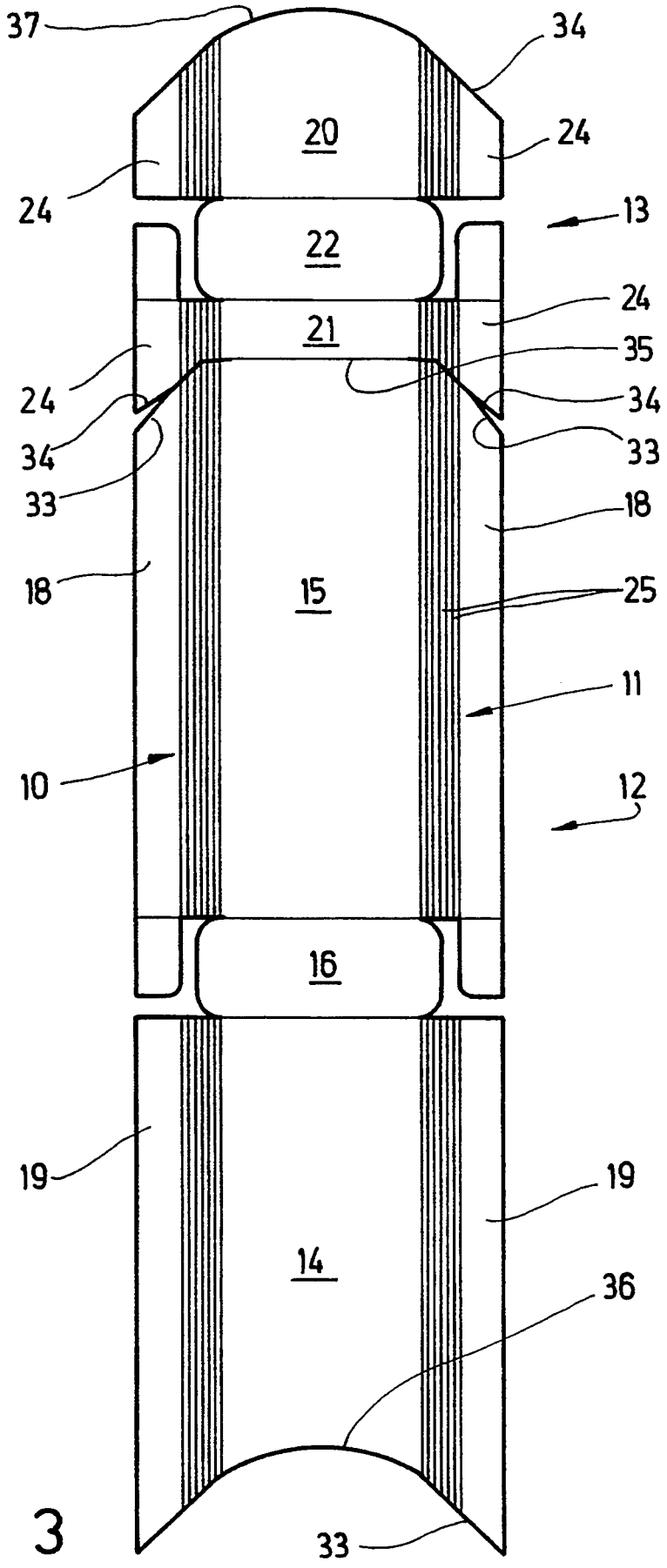
FIG. 3 shows a spread-out blank for a hinge-lid pack of FIG. 1.

Each rounded longitudinal edge 10, 11 is defined by a number of parallel grooves 25. These grooves 25 extend across the full length of the blank (FIG. 3), i.e. also in the region of the lid 13, in a port ion which corresponds to the rounding of the longitudinal edges 10, 11.

Figure 4:
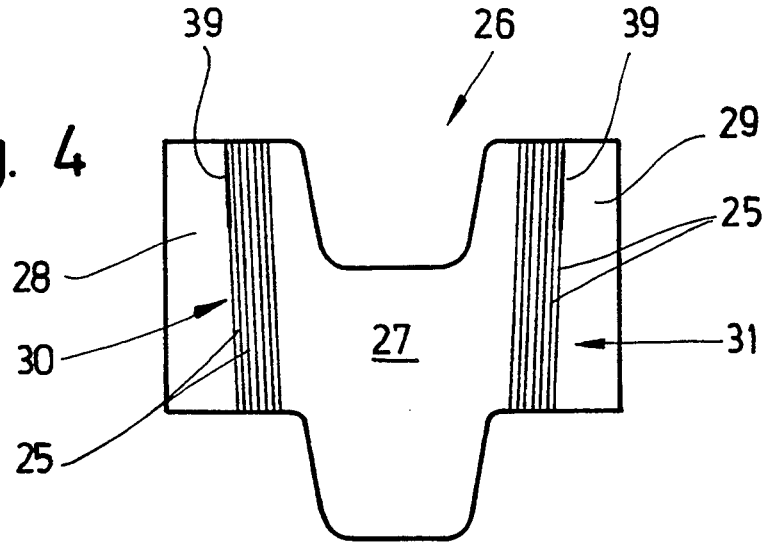
FIG. 4 shows a spread-out blank for a collar.
Figure 5:
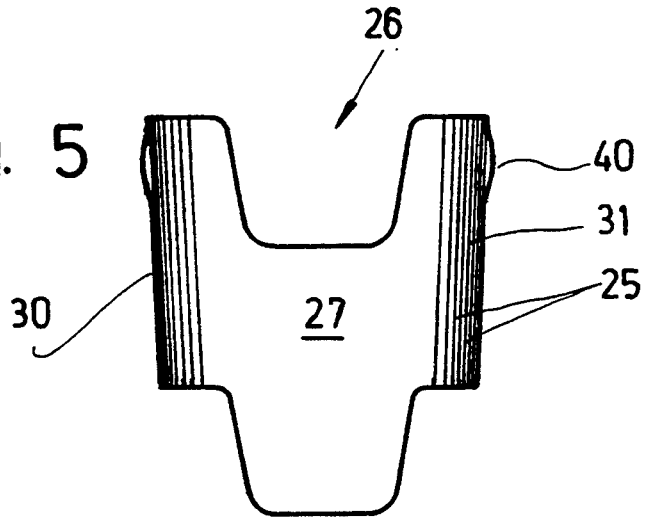
FIG. 5 is a front view of the collar of FIG. 4 in the folded position which corresponds to the arrangement in the hinge-lid pack.

The hinge-lid pack is provided with a collar 26 which is in this case formed from a separate blank (FIG. 4) and comprises a collar front panel 27 and collar side panels 28, 29. The collar 26 is also provided with rounded longitudinal collar edges 30, 31 which correspond to the longitudinal edges 10, 11 of the pack part 12 and the lid 13.

The collar 26 is inserted into the pack part 12 in such a way that approximately a half portion 32 of the collar projects upwardly from the pack part 12. At least the collar front panel 27 is adhesively connected to the inner side of the pack front panel 14. The collar port ion 32 which projects from the pack part is surrounded by the lid 13 when the hinge-lid pack is in the closed position.

In the closed position, closing edges of, on the one hand, the pack part 12 and, on the other hand, the lid 13 abut one another. These edges are, on the one hand, inclined side edges 33 of the pack part 12 which are located in the region of the pack side panels 17 and, on the other hand, counter edges 34 located in the region of the lid side panels 23. Said edges are inclined and slope towards the front side of the pack. In the region of the pack rear side, the edges lead to a pivoting hinge 35 which links the pack rear panel 15 with the lid rear panel 21.

At the front side of the pack, the lateral butt edges (side edges 33 and counter edges 34) are extended in the form of a front edge 36 which delimits the pack front panel 14 and in the form of a lid front edge 37 located in the region of the lid front panel 20.

The collar 26 is arranged within the pack part 12 in such a way that the collar portion 32 which projects upwardly from the pack part 12 has an outwardly directed deformation or bow in the region of the collar side panels 28 and/or 29. In this case, this deformation or bow is in the form of a cross-sectionally curved convexity 38. As a result, the transverse dimensions of the collar 26 increase in the direction towards the free upper edge (see FIG. 1). The dimensions of the convexity 38 are defined such that it partially laterally projects slightly beyond the contours of the pack part 12.

When the lid 13 is being closed and, mainly, in the closed position of the lid 13, the inner faces of the lid side panels 23 contact the collar side panels 28, 29 in the region of the convexity 38 with an increased pressure and therewith an increased friction. As a result of the shape of the convexity 38 and the properties of the collar material, the convexity 38 can in this process be inwardly deformed by the pressure of the lid side panels 23. Thus, a significantly increased closing force is exerted on the lid 13 which causes the closing edges 33, 34 and 36, 37 to precisely abut one another. At the same time, the pack is just as easy to handle.

The described deformation or bowing of the collar side panels 28, 29 of the present exemplary embodiment is a result of the design of the collar 26 itself. The collar front panel 27 has a width which increases towards the top because the longitudinal collar edges 30, 31 extend in an upwardly diverging manner. This leads to a strain in the region of the collar side panels 28, 29 outside the pack part 12 which automatically effects the deformation or bowing, i.e. the convexity 38. The width of the collar front panel 27 may be selected such that in the region of entry into the pack part 12 it corresponds to the inside dimensions of the pack part 12 (width of the pack front panel 14). The divergence of the longitudinal collar edges 30, 31 may be 2° in each case relative to the longitudinal edges 10, 11.

The described inclined position of the longitudinal collar edges 30, 31 is also employed in the embodiment with rounded longitudinal edges. The grooves 25 in the region of the rounded longitudinal collar edges 30, 31 extend in parallel. They may diverge towards the top like the collar longitudinal edges 30, 31, as it is shown in the drawings. For technical manufacturing reasons, however, it is better if the groups of the grooves 25 are directed in parallel relative to one another.

The illustrated exemplary embodiment comprises another additional measure for creating an increased closing force which acts on the lid 13. For this purpose, the collar side panels 28, 29 are provided with an upright cut 39 in the region of the convexity 38. In the present embodiment, this cut 39 is arranged adjacent to the upper edge of the collar 26, particularly at the edge of the group of grooves 25. Thus, there is also a slight inclination or divergence of the cuts 39. The cuts 39 end a small distance away from the upper free edge, which means they are closed.

As a result of the convexity of the collar side panels 28, 29 within the pack, the cut 39 splits open. This creates an additionally projecting retaining edge 40 which effects a further increase of the friction at the inner side of the lid side panels 23 and therewith of the closing force. In the region of the convexity 38, the cut 39 is arranged such that the projecting retaining edge 40 has a barb-like effect on the lid side panels 23 when the lid 13 has reached the closed position. Accordingly, the retaining edge 40 is directed towards the front side of the pack.

Regardless of the described closing aids, the blank for the hinge-lid pack and, accordingly, the hinge-lid pack itself is designed in a special way. As is evident particularly from FIG. 3, the lid front edge 37 is designed in a special way, namely curved, particularly in the form of a part of an arc of a circle. In the region of the lid side panels 23, the ends of the curve are adjoined by rectilinear edges, particularly by the counter edges 34. The entire contour which delimits the blank of FIG. 3 at the lid end therefore comprises a curved center region (lid front edge 37) and, adjoining thereto, rectilinear legs (counter edges 34).

At the opposite end, the blank is designed correspondingly. The front edge 36, which forms the upper edge of the pack front panel 14, is also designed (concavely) curved and particularly matches the lid front edge 37. The side edges 33 of the lid side panels 17 which adjoin the curve also extend rectilinearly in accordance with the contour of the lid.

A blank design ed in this way can be manufactured in a material-saving manner, because, within a sheet or web of material, the blanks can directly abut one another in the region of the described edges 33, 34; 36, 37. The adjacent blanks only have to be severed in this region by a single punch or sever cut, without any waste of material.

The lid front panel 20 of the completed pack has one layer. This means that the inner lid tab which is usually present in such packs is missing. Moreover, the rounded embodiment of the closing edges matches the rounded longitudinal edges 10, 11.

Hinge-lid packs with rectangular longitudinal edges or polygonal or bevelled longitudinal edges can be formed analogously.

We claim:

1. A hinge-lid pack for accommodating a cigarette group, comprising:

a pack part (12) and a lid (13) which is pivotably attached thereto, a) wherein the hinge-lid pack is a round-corner pack with rounded upright longitudinal edges (10, 11);

b) a collar (26) with a collar front panel (27) and collar side panels (28, 29), which collar (26) is arranged in the pack pan (12) and has a collar portion (32) that projects upwardly from the pack part (12), c) so that said collar portion (32) is surrounded by said lid (13) when said lid is in a closed position; and d) closing edges which are formed between said pack part (12) and said lid (13), which extend in an inclined manner to form an inclination in the region of pack side panels (17) and lid side panels (23), and which slope towards the pack front side, e) wherein said lid (13) has a single-layer front panel (20) with a rounded tongue-like contour in a lower region thereof which faces towards the pack part (12), thus forming a rounded free front edge (37) of said lid (13).

2. The hinge-lid pack as claimed in claim 1, wherein, with respect to said inclination, said rounded lid front edge (37) forms an extension of closing edges of said lid (13) in the region of said lid side panels (23).

3. The hinge-lid pack as claimed in claim 1, wherein free edges of a pack from panel (14) and adjoining side tabs (19) thereof are configured in accordance with said contour of said lid front panel (20), including lid side tabs (24).

4. The hinge-lid pack as claimed in claim 2, wherein free edges of a pack from panel (14) and adjoining side tabs (19) thereof are configured in accordance with said contour of said lid from panel (20), including lid side tabs (24).

5. The hinge-lid pack as claimed in claim 1, wherein only said free lid front edge (37) is rounded, and wherein said closing edges between said lid (13) and said pack part (12) form a straight, uncurved extension of the closing edges between pack side panels (17) and lid side panels (23) in a region of said rounded upright longitudinal edges (10, 11).

6. The hinge-lid pack as claimed in claim 2, wherein only said free lid from edge (37) is rounded, and wherein said closing edges between said lid (13) and said pack part (12) form a straight, uncurved extension of the closing edges between pack side panels (17) and lid side panels (23) in a region of said rounded upright longitudinal edges (10, 11).

7. The hinge-lid pack as claimed in claim 3, wherein only said free lid front edge (37) is rounded, and wherein said closing edges between said lid (13) and said pack part (12) form a straight, uncurved extension of the closing edges between pack side panels (17) and lid side panels (23) in a region of said rounded upright longitudinal edges (10, 11).

8. The hinge-lid pack as claimed in claim 4, wherein only said free lid front edge (37) is rounded, and wherein said closing edges between said lid (13) and said pack part (12) form a straight, uncurved extension of the closing edges between pack side panels (17) and lid side panels (23) in a region of said rounded upright longitudinal edges (10, 11).

* * * * *